US008936016B1

(12) United States Patent
Phelps

(10) Patent No.: US 8,936,016 B1
(45) Date of Patent: Jan. 20, 2015

(54) AMBIENT TEMPERATURE PHASE CHANGE LAUNCHER

(71) Applicant: Peter T. Phelps, Wakefield, RI (US)

(72) Inventor: Peter T. Phelps, Wakefield, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/040,801

(22) Filed: Sep. 30, 2013

(51) Int. Cl.
*F41F 3/07* (2006.01)

(52) U.S. Cl.
CPC ..... *F41F 3/07* (2013.01)
USPC ..... 124/71

(58) Field of Classification Search
USPC ..... 124/69–71, 73
See application file for complete search history.

(56) References Cited

U.S. PATENT DOCUMENTS 7,617,818 B1 * 11/2009 Turchik et al. ..... 124/64
8,322,329 B1 * 12/2012 Sikes ..... 124/73

* cited by examiner

*Primary Examiner* — Michael David
(74) *Attorney, Agent, or Firm* — James M. Kasischke; Michael P. Stanley

(57) ABSTRACT

A system for ejecting a missile from a submerged vessel includes: a tube for housing the missile; a tank for storing atmospheric gas as a pressurized liquid, whereby a valve is connected to the tank to allow release of the gas into the tube to eject the missile from the tube; and a microwave emitter located within the liquid in the tank to input heat energy into the liquid to maintain evaporation of the liquid into the gas, whereby the microwave emitter is activated simultaneously with the release of the gas into the tube.

6 Claims, 3 Drawing Sheets

AMBIENT TEMPERATURE PHASE CHANGE LAUNCHER

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION (1) Field of the Invention

The present invention generally relates to a system for ejecting a missile from a submerged vessel. The system includes a tank for storing atmospheric gas as a pressurized liquid; whereby, the release of the gas into the tube ejects the missile. A microwave emitter located within the tank, simultaneously inputs heat energy into any residual liquid to maintain evaporation of the liquid into the gas.

(2) Description of the Prior Art

Submarine launched missiles are traditionally ejected by gas pressure from vertical launch tubes, or by water impulse from horizontal torpedo tubes. A number of launch platforms for cruise missiles have been deployed—including surface ships and submarines. In each, a missile is stored and launched from a pressurized canister that also protects the missile during transportation and storage.

A vertically-launched missile is typically ejected from a capsule by a gas generator which burns a propellant. This propellant burn increases the pressure below the missile to launch the missile out of the capsule or tube. After a launched missile exits the water; a solid fuel booster ignites for a few seconds of airborne flight and until a transition to cruise.

After the missile leaves the submarine, seawater enters the capsule and mixes with the gas generator residue. The water in the capsule is then considered hazardous material and must be pumped out into a special container to be disposed of. This type of missile tube maintenance is expensive.

A variant to the conventional gas propellant launching system is a submarine steam generator missile ejection system as described in U.S. Pat. No. 7,451,680 issued to Pelto. The Pelto ejection system was likely developed to eliminate explosive ordnance safety concerns as well as concerns of hazardous material disposal costs.

The Pelto system has a vessel containing water in which the water becomes a pressurized steam source for missile ejection. However, the size of the vessel is prohibitively large and the delay for heating the water to create sufficient steam pressure prior to launch is undesirable.

SUMMARY OF THE INVENTION

Accordingly, it is a primary object and general purpose of the present invention to provide a system and method of use for launching a missile or other payload.

It is further object of the present invention to provide an environmentally-acceptable launching system.

It is a still further object of the present invention to provide a launching system which reduces maintenance requirements.

To attain the objectives listed; a system is provided for ejecting a missile from a submerged submarine and includes a tube or capsule for housing the missile. The system also includes a tank for storing atmospheric gas as a pressurized liquid; whereby, a valve is connected to the tank to allow release of the gas into the tube to eject the missile.

A microwave emitter located within the liquid in the tank; inputs heat energy to maintain evaporation of the liquid into a gas. The microwave emitter is activated simultaneously with the release of the gas into the tube. The launching system does not require the microwave emitter component although the addition of the emitter ensures full evaporation of the liquid in the tank.

The system can also include components such as multiple valves for storing and releasing gas throughout the system; an expansion chamber that allows pockets of liquid in the tank to expand into a gas; a pressure regulator to ensure that the missile does not accelerate beyond specifications; and a diffuser plate to distribute the gas evenly around the base of the missile during launch.

A method of ejecting a projectile includes the steps of: storing an atmospheric gas as a pressurized liquid in a tank having a valve; ejecting the projectile from a tube by opening the valve to allow the liquid to evaporate into gas in the tube; and maintaining evaporation of the liquid during ejection of the projectile by activating a microwave emitter within the tank when the valve is opened.

BRIEF DESCRIPTION OF THE DRAWINGS

The above and other objects, features and advantages of the present invention will become apparent in view of the following figures, not drawn to scale, taken in conjunction with the specification and claims.

DETAILED DESCRIPTION OF THE INVENTION

Figure 1:
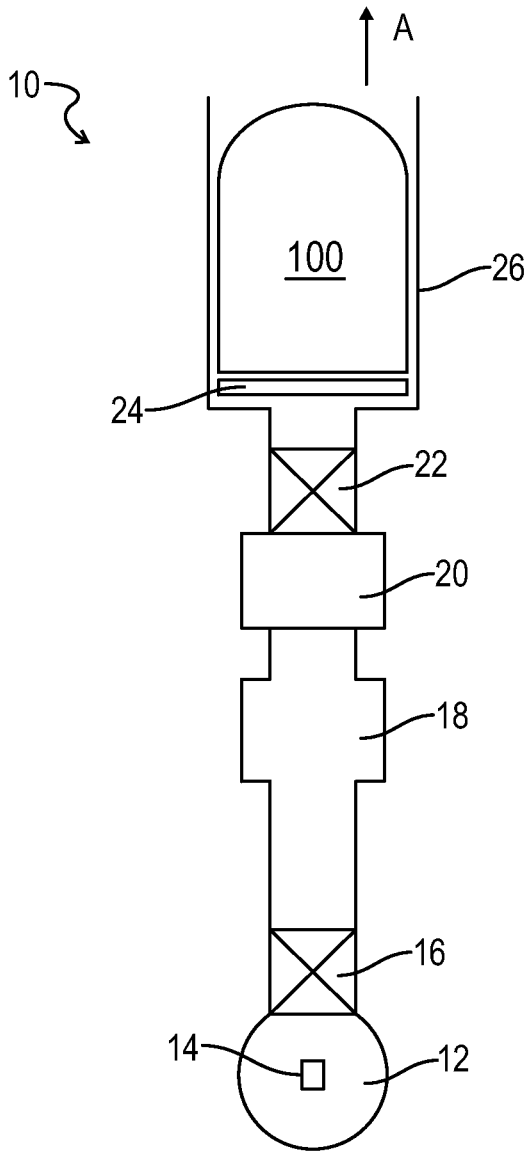
FIG. 1 is a diagram of a projectile ejection system according to the present invention.

The purpose of the ambient temperature phase change launcher system (hereafter called "launcher system) is to eject a missile or other payloads (such as countermeasures) from a submerged submarine or other similarly configured platforms. Examples of platforms include a surface ship or when the submarine is afloat.

The launcher system can replace a current gas generator ejection system that carries a significant burden for explosive safety, hazardous waste cleanup and an elimination of off-hull logistical infrastructure supporting explosive bunkering, lot testing, energetic aging analysis, transport, and disposal of explosive materials. Also, the launcher system can launch a missile at an ambient temperature without the use of explosives and without creating hazardous waste.

The launcher system includes a tank for storing pressurized liquid that will expand 500 to 1000 times an original volume depending on the type of gas used. Atmospheric gas is preferred for use and compression into a liquefied state in the storage tank. The atmospheric gas includes, but is not limited to, carbon dioxide, nitrogen, argon, neon, helium, nitrous oxide, carbon monoxide or xenon.

For example, carbon dioxide has an expansion ratio of 553 meaning that one molecule of $CO_2$ in a liquid state will expand by a factor of 553 when converted into a gaseous state.

This change from a liquid to a gaseous state of an atmospheric gas releases a tremendous amount of energy which can be transferred to a launch tube for launching a missile. The energy to launch the missile is stored in the liquid phase of the atmospheric molecule (e.g., $CO_2$ or $N_2$) at ambient temperature. The result of this type of storage is similar to storing energy in a spring. Instead of compressing a coil; a gas is compressed into a liquid.

Energy for the launcher system can be stored in the tank using any atmospheric gas or molecule present in the atmosphere. These gases are generally abundant and environmentally acceptable. However, hydrogen and oxygen combined is highly combustible. Also, compressed oxygen itself is not combustible, but highly dangerous and can cause explosion without stringent safety precautions. As such oxygen in this state should not be considered for the launcher system.

Nitrogen can work well although the gas has a very low boiling point for evaporation; therefore, the gas would require a high pressure tank to keep the gas in a liquid state. Argon is a good candidate for use because argon is a noble gas (the third most common gas in the atmosphere of the earth behind nitrogen and oxygen) and a stable inert gas that is resistant to bonding with other elements.

Carbon dioxide is another good candidate because the gas can be stored at a liquid state at room temperature at approximately 800 psi. Other atmospheric molecules can also be used based on cost, chemical properties, etc.

The preferred storage tank capable of holding enough liquefied atmospheric gas to launch a single standard missile or the like has a volume of 1.5 to 2.0 liters. Other storage tanks could be utilized to launch different size and weight payloads; but, it is essential to minimize the size of the tanks since the tanks will be used on submarines or similar vessels which have limited space constraints. Also, the use of a liquefied atmospheric gas enables enough energy in a 1.5 to 2.0 liter tank for a launch; whereas, the use of other gases may require larger, heavier and explosively dangerous tanks.

In one embodiment, the pressurized atmospheric gas is compressed and stored as liquid in a tank and connected to a launch tube. The tank includes a valve which is opened to launch the missile by releasing the gas into the launch tube. The pressurized liquid quickly evaporates and fills the tube to eject the missile. The pressure inside the tank would stay at 800 psi until all the liquid changed to gas. The size of the piping between the tank and launch tube will greatly effect the pressure inside the launch tube. If the piping has a small diameter then the pressure will build very slowly inside the launch tube. If the piping diameter is comparatively very large; then, the pressure will build too fast inside the launch tube and accelerate the projectile too fast.

In another embodiment, the gas flows from the tank through a priming valve into an expansion chamber. The priming valve is a tank valve which is kept closed during storage. When a launch is anticipated, the priming valve is opened to allow the liquid to evaporate and to travel into the other components of the launcher system.

The gas travels through a pressure regulator which ensures that the missile is not accelerated beyond a maximum "G force". Finally, a firing valve releases the atmospheric gas into the launch tube at time to launch. A diffuser plate can be positioned underneath the missile to evenly distribute pressure during launch.

When highly pressurized atmospheric gas is nearly instantaneously vaporized; a tremendous amount of heat energy is released and lost from the liquid to the gas due to a change of state. The remaining liquid in the tank thus becomes very cold which can impede vaporization of the remaining liquid. To counter this problem, a microwave emitter is installed in the tank in direct contact with the pressurized liquid in order to input heat energy throughout the liquid; thereby, maintaining, accelerating or otherwise controlling the evaporation rate of the liquid in order to maintain a continuous evaporation rate during launch.

The following list provides a detailed description of various components used in different embodiments of the launcher system.

Tank—The tank is preferably a thin-walled cylinder with hemispherical caps on both ends and is designed to withstand pressures in the range of 800 to 1000 psi. The tank can be made of high strength metal or a composite material to reduce weight and/or wall thickness. The tank preferably has a flange at the top to allow the tank to be filled and to allow the gas to escape. The dimensions of the tank are relatively small compared to the rest of the launcher system. For instance, the tank diameter is less than or equal to the launch tube diameter.

Microwave Emitter—As the liquid converts to gas, this optional but helpful component pulls energy from the liquid to reduce the latent heat of the fluid. The microwave emitter transmits energy into the remaining fluid inside the tank to keep the fluid evaporating into a gas. Other sources of heat can be used (such as electrical coils); however, some of these sources only heat the liquid in direct contact therewith; whereas, the microwave emitter can transmit heat throughout the volume of the tank.

Priming Valve—The priming valve is located just above the tank and opened shortly before launch. The priming valve is an optional component which isolates the tank from the other components. The priming valve is closed during storage.

Expansion Chamber—This is a comparatively small cylinder that allows pockets of liquid in the tank to expand fully into a gas. The optional expansion chamber preferably reduces to connectors at each end.

Pressure Regulator—The regulator reduces the pressure of the gas so that the missile is not accelerated beyond specifications. The pressure regulator must have a high flow rate. Several pressure regulators can be combined in parallel to reach a required flow rate for the payload.

Firing Valve—The firing valve is located just below the missile tube. The valve can be located at the side of the missile tube; the valve just has to be behind the missile. When the firing valve is opened; gas flows into the missile tube and forces the missile out with the result of launching the missile.

Diffuser Plate—The diffuser plate can be used to distribute the gas evenly around the base of the missile during launch to ensure that the missile is ejected properly out of the tube.

Tube—This is the launch tube, capsule or cylinder that holds the missile in place with launch seals and is capable of withstanding launch pressures.

Missile—This is the payload that will be ejected from the launch tube.

The launcher system of the present invention is unique in that the system creates a launch pulse capable of launching a cruise missile from a submarine without a chemical reaction. The launcher system provides launch capability by utilizing energy released when liquefied atmospheric molecules undergo a phase change to a gaseous state.

The entire reservoir of liquid propellant is preferably used to launch the missile. The technology to vaporize an entire tank of liquid propellant in order to launch a sizably-large projectile has not previously been demonstrated. In order to meet this requirement; extremely high flow rates are required through the valves, expansion chamber and regulator of the launcher system.

Referring now to the drawings, and more particularly to FIG. 1, a launcher system 10 is illustrated in a vertical orientation in a launch tube 26 in which a projectile 100, such as a Tomahawk missile, could be launched in direction "A". FIG. 1 is not drawn to scale since a typical launch tube would have a length many times greater than the diameter of the tube.

The launcher system can be tilted at various angles from the vertical, or the system could be positioned in a horizontal orientation for ejection or launch. However, the tank opening for the release of gas into the missile tube must be located at the functional top of the tank so that gas and not liquid will come out of the tank during a launch.

The launcher system 10 includes a storage tank 12 which stores atmospheric gas such as carbon dioxide, nitrogen, argon, neon, helium, nitrous oxide, carbon monoxide or xenon at high pressure in a liquefied state. By using an atmospheric gas, pollution of the ocean or the atmosphere by the launch of a missile is minimized since the primary fuel to launch the missile is gases naturally present in the atmosphere.

The storage tank 12 can be constructed of high strength steel, stainless steel or composite materials to reduce wall thickness and weight while maintaining the necessary strength to secure the pressurized liquefied atmospheric gas. The tank 12 includes or is connected to a tank valve or priming valve 16 which is kept in a closed or OFF position for storing liquid in the tank. The tank preferably has a flange at the top to allow the tank to be filled; to allow the gas to escape; and to allow installation of a microwave emitter 14. The tank 12 can also include other filling, pressure and temperature sensing ports (not shown) as well as a pressure relief valve.

When the priming valve 16 is opened or in the ON position; the atmospheric gas is formed by evaporation of the liquid which then travels into an expansion chamber 18. The expansion chamber 18 is a small cylinder that allows pockets of liquid to expand fully into a gas. The expansion chamber 18 reduces to connectors at each end.

The next structural component of the launcher system 10 is a pressure regulator 20 adjacent to the expansion chamber 18. The pressure regulator 20 reduces the pressure of the gas so that the missile is not accelerated beyond specifications. The pressure regulator 20 is preferably a high flow rate regulator; however, several regulators could be combined in parallel to reach the required flow rate for the payload.

The cylindrical tube 26 acts as housing for storing the missile or projectile 100. A firing valve 22 is positioned in the gas flow between the pressure regulator 20 and the tube 26. When the firing valve 22 is in a closed position and gas is present throughout the launcher system 10 due to the opening of the priming valve 16; then the missile 100 is ready to launch. At that point, opening the firing valve 22 will launch the missile by allowing all of the gas in the launcher system 10—specifically from the tank 12 to surge into the tube 26.

A diffuser plate 24 can be positioned along the bottom of the tube 26 to aid in the diffusion and equal distribution of the gas upon firing. Depending on the payload being launched and the gas molecules being used; the pressure regulator 20 and the diffuser plate 24 may not be necessary although these components generally help to control the speed and acceleration of the projectile 100 upon launch.

When highly pressurized atmospheric gas such as $CO_2$ is nearly instantaneously vaporized; a tremendous amount of heat energy is lost from a change of state reaction. The reaction cools the remaining liquefied gas in the tank and impedes the vaporization of the remaining liquid in the tank. To counter this problem, the microwave emitter 14 is installed in the tank (preferably in direct contact with the pressurized liquid) in order to input heat energy into the liquid. The heat energy maintains and/or accelerates or otherwise controls the evaporation rate of the liquid to maintain a consistent evaporation rate during launch.

Figure 2:
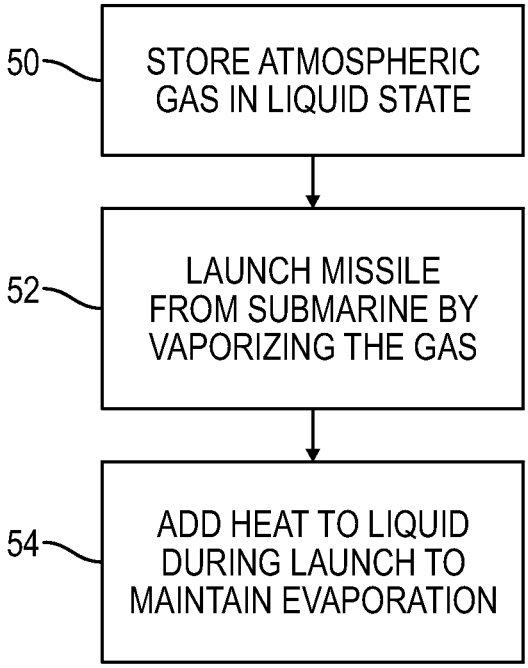
FIG. 2 is a flowchart of a embodiment of a method according to the present invention.

FIG. 2 is a flowchart of a preferred embodiment of a method according to the principles of the invention. In the method, atmospheric gas is stored in a liquid state (step 50) in a high pressure tank with a typical volume of 1.0-2.0 liters. Other sized tanks that are smaller or larger in volume could be used to provide enough energy for the launch of a particular missile or other projectile or payload.

The missile 100 is launched (step 52) when gas is released from the storage tank 12 and is channeled into the launch tube 26. As previously explained, heat is preferably added (step 54) to the liquid in the tank 12 during release of the gas in order to allow evaporation of all of the liquid within the tank. The microwave emitter 14 is preferred to heat the liquid.

Figure 3:
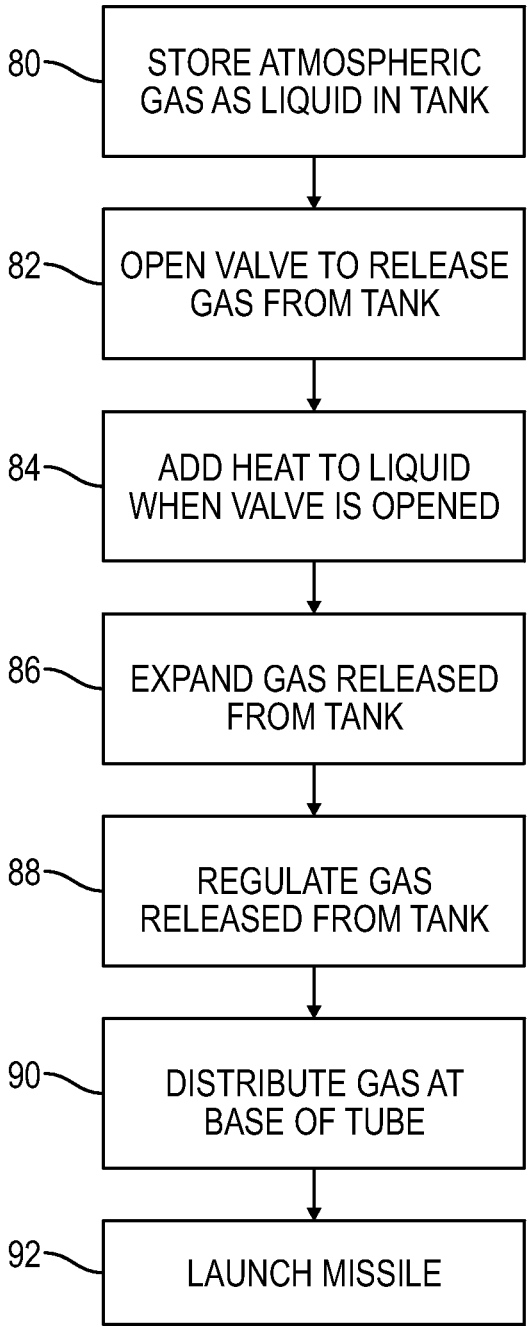
FIG. 3 is a flowchart of an embodiment of an alternate method according to the present invention.

FIG. 3 is a flowchart of an alternate embodiment of a method according to the principles of the invention. In the method, atmospheric gas is stored in a liquefied state in a tank 12 (step 80). In order to launch a missile; a valve is opened (step 82) to allow gas to vaporize from the liquid in the tank 12, and to release the gas into the launcher system 10. Heat is added to the liquid by controlling the microwave emitter 14 (step 84) when the valve is opened.

The gas released from the tank 16 is expanded in an expansion chamber (step 86), and the gas pressure is regulated so as to not exceed the specifications of the missile launch tube (step 88). Finally, the gas is distributed evenly around the base of the launch tube 26 (step 90) and the missile 100 is launched (step 92).

The launcher system 10 is different from a compressed air system because the launcher system creates a large volume of gas from a small tank. For example, a phase change missile launcher with a one liter tank of liquid carbon dioxide at 800 psi can create about 553 liters of gaseous carbon dioxide at 1 bar. In comparison, the pressure required for a compressed air system to create 500 liters of air at 1 bar from a one liter tank is approximately 500 bars or 7000 psi.

The launcher system 10 is also different from a steam generator missile ejection system in that the launcher system does not have a requirement for heating water which is necessary for the steam generator system. The heating process would cause a time delay which is undesirable to the submarine community because of the need to launch quickly. By using an atmospheric molecule that is normally a gas at ambient temperature, there is no need to heat the molecule. Therefore, the launcher system 10 can be ready to launch with minimal notice.

Another concern with the steam generator system is the condensation of the steam bubble as the bubble comes into contact with seawater. This condensation can possibly reduce the effectiveness of the system. In contrast, a bubble of carbon dioxide as used in the present invention remains in a gaseous phase in the ocean.

There are many additional advantages of the launcher system 10 over prior art missile launch systems. For instance, many different sized payloads can be launched using the launcher system 10 by changing the molecule used; the pressure of the stored liquid molecule, the pressure regulation and the flow rate of the gas. As previously mentioned, there are negligible post launch cleanup costs compared to currently-used gas generator ejection systems.

Also, the inventive launcher system 10 does not need preparations before launch. Launching simply entails opening one or two valves to eject the missile. Furthermore the launcher system 10 operates at ambient temperatures so there is no requirement to heat or cool any fuel or components, other than the use of a microwave emitter 14 to add heat into the pressurized liquid during launch.

An additional advantage of the launcher system 10 is that after the launch of a missile; the missile housing or launch tube 26 is not left with any hazardous materials or residue that requires special maintenance and cleaning as is the case with a conventional gas-fired launching system.

Advantages of the launcher system 10 for the submarine or the vessel include: (1) no hazardous material disposal costs for gas generator post missile launch cleanup and waste water removal; (2) no hazardous material disposal costs associated with outdated or exceeding the operational service life of gas generators; (3) no engineering analysis, performance tests, and monitoring costs associated with gas generator current life cycle philosophy; (4) no labor costs for replacing expended or obsolete gas generators; and (5) reduced risk to the submarine and crew since there is no need to perform a surfaced tube dewatering procedure at sea.

Advantages of the launcher system 10 when maintained at land-based facilities include: (1) no explosive ordnance bunker maintenance and personnel monitoring costs; (2) reduced documentation cost without the need for explosive ordnance review requirements; and (3) minimal transportation costs since the launcher system is an integrated part of the vessel.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A system for ejecting a projectile, said system comprising:

a tube for housing the projectile;

a valve fluidly connected to said tube;

a tank fluidly connected to said valve on a side of said valve opposite to said tube wherein said tube is capable of storing an atmospheric gas as a pressurized liquid and capable of releasing the gas by opening said valve with the released gas to ejecting the projectile from said tube; and a microwave emitter located within said tank, said emitter capable of inputting heat energy into the liquid to maintain evaporation of the liquid into the gas with said microwave emitter capable of activation when said valve is opened to release gas.

2. The system of claim 1 wherein a volume of said tank is capable of storing one liter of liquid carbon dioxide stored at 800 psi to evaporate into 500 liters of gaseous carbon dioxide at a pressure of 1 bar.

3. The system of claim 1 wherein said tank comprises a volume of 1.0 to 2.0 liters.

4. The system of claim 1 further comprising a diffuser plate located at a base of said tube to distribute the gas around the base of the projectile when said valve is opened.

5. The system of claim 1 further comprising at least one pressure regulator located between said tank and said tube.

6. The system of claim 1 further comprising an expansion chamber located between said tank and said tube, to allow expansion of the liquid into the gas.

* * * * *